United States Patent [19]

Lie et al.

[11] Patent Number: 5,020,253

[45] Date of Patent: Jun. 4, 1991

[54] DISPLAY BOARD ASSEMBLY

[76] Inventors: Liat-Chaw Lie, 40 Hillcroft Rd., Markham, Ontario, Canada, L3S 1P8; Huang K. Suen, 167 Strathearn Ave., Richmond Hill, Ontario, Canada, L4B 2M7

[21] Appl. No.: 475,533

[22] Filed: Feb. 6, 1990

[51] Int. Cl.[5] ..... G09F 13/04

[52] U.S. Cl. ..... 40/576; 40/573

[58] Field of Search ..... 40/575, 576, 570, 573; 403/339, 354, 375

[56] References Cited

U.S. PATENT DOCUMENTS

| | | | |
|---|---|---|---|
| 4,058,919 | 11/1977 | Wakabayashi | 40/573 X |
| 4,371,285 | 2/1983 | Behar | 403/339 |
| 4,532,579 | 7/1985 | Merryman | 40/576 X |
| 4,682,147 | 7/1987 | Bowman | 40/570 X |
| 4,765,080 | 8/1988 | Conti | 40/576 |

FOREIGN PATENT DOCUMENTS

| | | | |
|---|---|---|---|
| 586155 | 11/1959 | Canada | 40/576 |

*Primary Examiner*—Laurie K. Cranmer
*Assistant Examiner*—J. Bonifanti
*Attorney, Agent, or Firm*—Varndell Legal Group

[57] ABSTRACT

A display board assembly, which includes a start unit connected to an end unit with a variety of intermediate display units set in therebetween in a line. By means of color contrast and diaphaneity difference the symbols on the intermediate which show a certain meaning collectively can be clearly seen in the day. When in the dark, a photosensor automatically triggers the light emitting diodes of the intermediate display units to illuminate the symbols thereon.

7 Claims, 5 Drawing Sheets

DISPLAY BOARD ASSEMBLY

BACKGROUND AND SUMMARY OF THE INVENTION

The present invention relates to display boards and, more particularly, to a built-up type display board for showing a house number, name of householder or other symbols.

Regular doorplates, signboards, or other display boards are generally made according to order. This is indeed expensive and requires a certain period of time to order a doorplate, signboard or the like. Further, regular doorplates are not clearly visible in the night or dark weather. Therefore, an additional lighting device is necessary.

One object of the present invention is to provide a display board assembly which can be made through mass production for reducing its cost.

Another object of the present invention is to provide a display board which can be flexibly assembled according to requirement.

Still another object of the present invention is to provide a display board which utilizes a photosensor to control its light emitting elements to produce light when it is dark.

DETAILED DESCRIPTION OF THE PREFERRED EMBODIMENT

Figure 1:
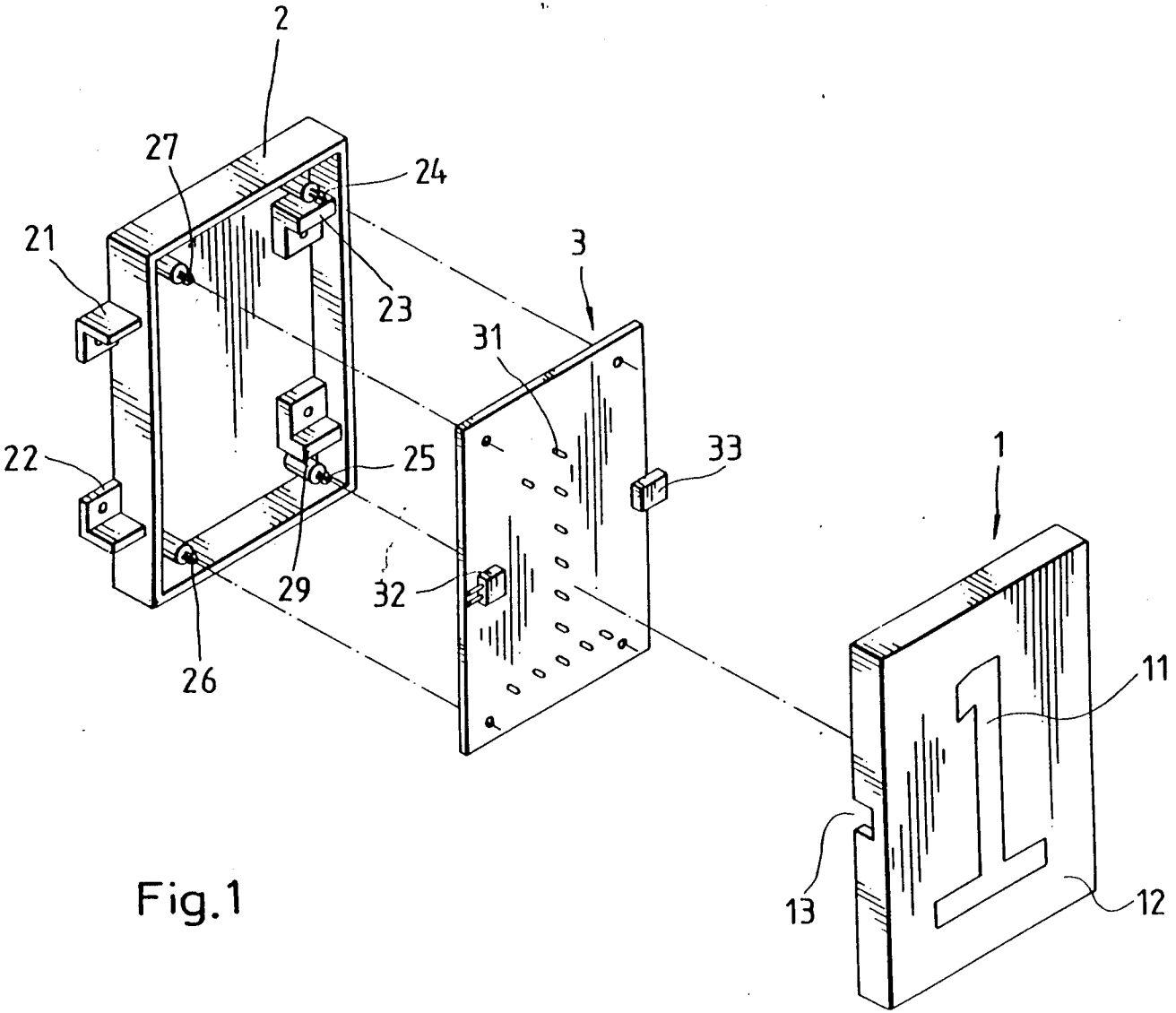
FIG. 1 is a fragmentary perspective view of a symbol display unit according to the present invention.

With reference to FIG. 1, a symbol display unit in accordance with the present invention includes a front panel 1 attached to a bottom block with a printed circuit board 3 received therein, in which the front panel 1 has a symbol therein, which symbol can be a number, character or sign.

A front pale 1 of a symbol display unit in accordance with the present invention comprises a transparent symbol portion 11 and an opaque non-symbol portion 12 on its front face, wherein the transparent symbol portion 11 is tinted colorless, and the opaque non-symbol portion 12 is colored in such a way to present a striking contrast to the transparent symbol portion 11 so that the symbol thereon can be prominent and clearly seen in the day. A bottom block 2 of a symbol display unit according to the present invention has an edge about its periphery extending from the bottom block to the front panel defining a top edge, a bottom edge and two side edges an unitary upper L-shaped projecting end 21 and a lower L-shaped projecting end 22 extending from one side two L-shaped recesses 23, 29 arranged within an opposite side matching the L-shaped projecting ends 21, 22, four stub tenons 24, 25, 26, 27 internally upstanding therefrom in the four corners thereof for the positioning therein of a printed circuit board 3. A printed circuit board 3 of a symbol display unit of the present invention comprises a plurality of light emitting diodes 31 respectively arranged at an area corresponding to the symbol portion 11 of the front panel 1 of such a symbol display unit, a power plug 32 thereon, and a power socket 33 opposite to its power plug 32. Further, the front panel 1 of a symbol display unit comprises and edge about is periphery with two notches 13 corresponding to the power plug 32 and the power socket 33 of a printed circuit board 3. Therefore, when a printed circuit board 3 is received in a bottom block 2 and a front panel 1, the power plug 32 and the power socket 33 of such a printed circuit board 3 are exposed for connection.

Figure 2:
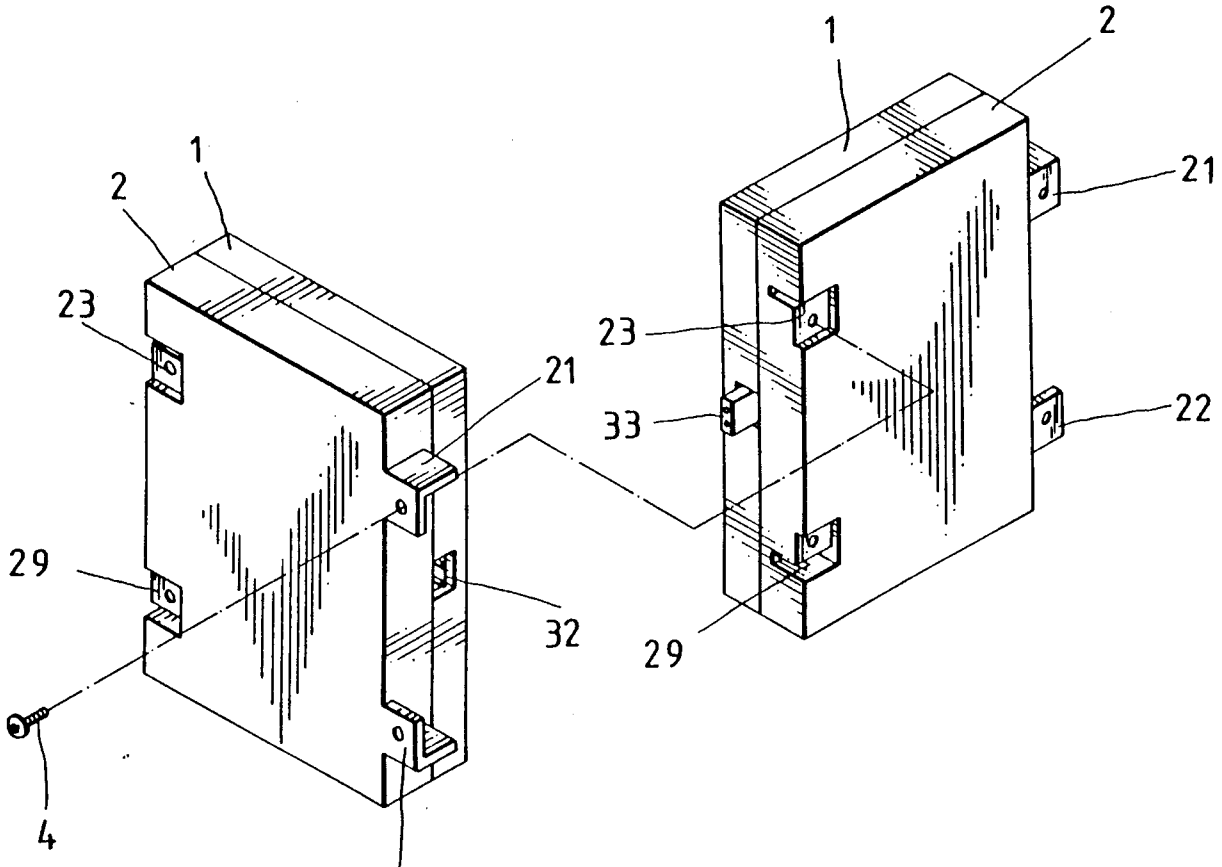
FIG. 2 is a schematic drawing illustrating the connection of one symbol display unit with another.

As illustrated in FIG. 2, two or more symbol display units of the present invention can be conveniently connected together by means of screws 4 or lock pins to form a board assembly. The two L-shaped projecting ends 21, 22 of the bottom block 2 of one symbol display unit are respectively set in the two L-shaped recesses 23, 29 of another symbol display unit and firmly fixed up together by means of screws 4 through the holes thereon.

Figure 3:
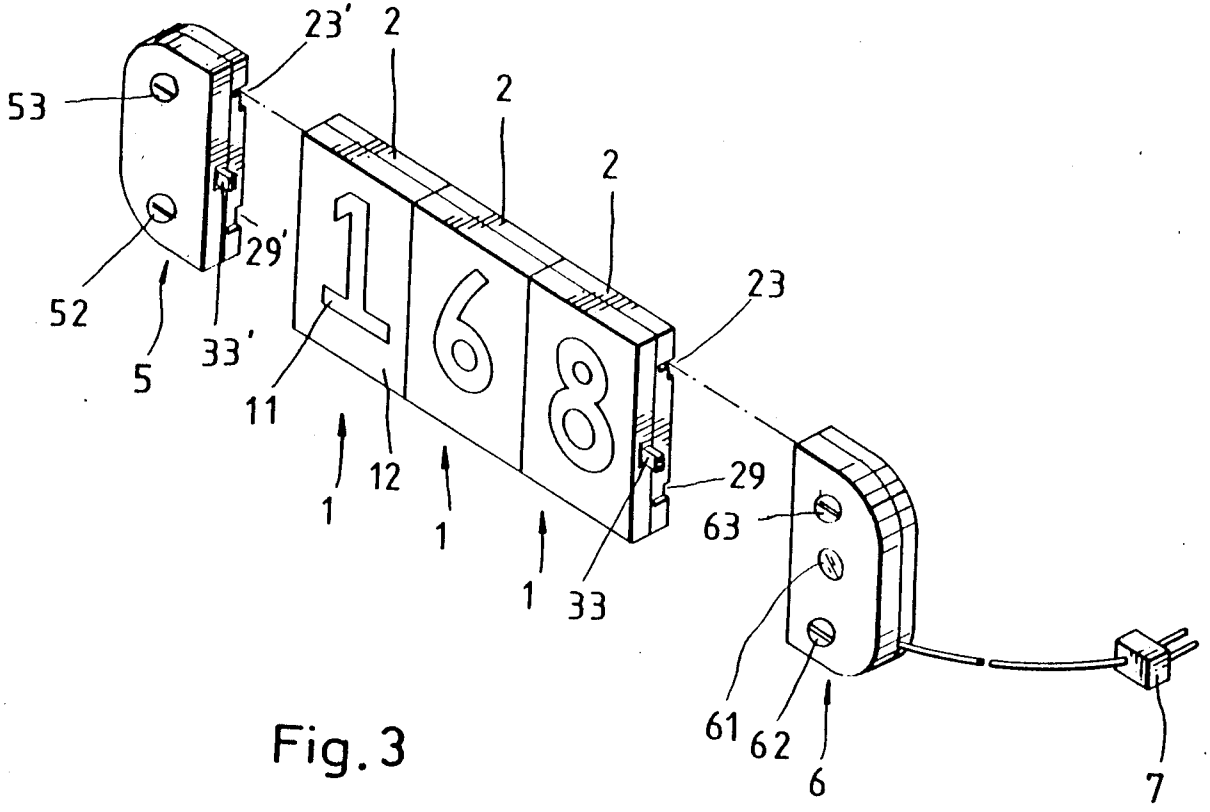
FIG. 3 is a schematic drawing illustrating an operation to couple three symbol display units with a start unit and an end unit.

Referring to FIG. 3, a start unit 5 of the present invention comprises two L-shaped recesses 23', 29' and a power socket 33' corresponding to the two L-shaped projecting ends 21, 22 and the power plug 32 of a symbol display unit for connection (Please refer to FIG. 2). An end unit 6 of the present invention comprises two L-shaped projecting ends and a power plug corresponding to the two L-shaped recesses and the power socket of a symbol display unit connection. In a display board assembly, the start unit 5 and the end unit 6 are respectively structured to compensate for each other and can be secured to a wall be screws 52, 53, 62, 63. Each end unit 6 also comprises a window 61 through which a photosensor therein can detect the intensity of outside light, and a power supply device 7 to convert regular alternating current power to a lower voltage of alternating current power for the operation of the present invention.

Figure 4:
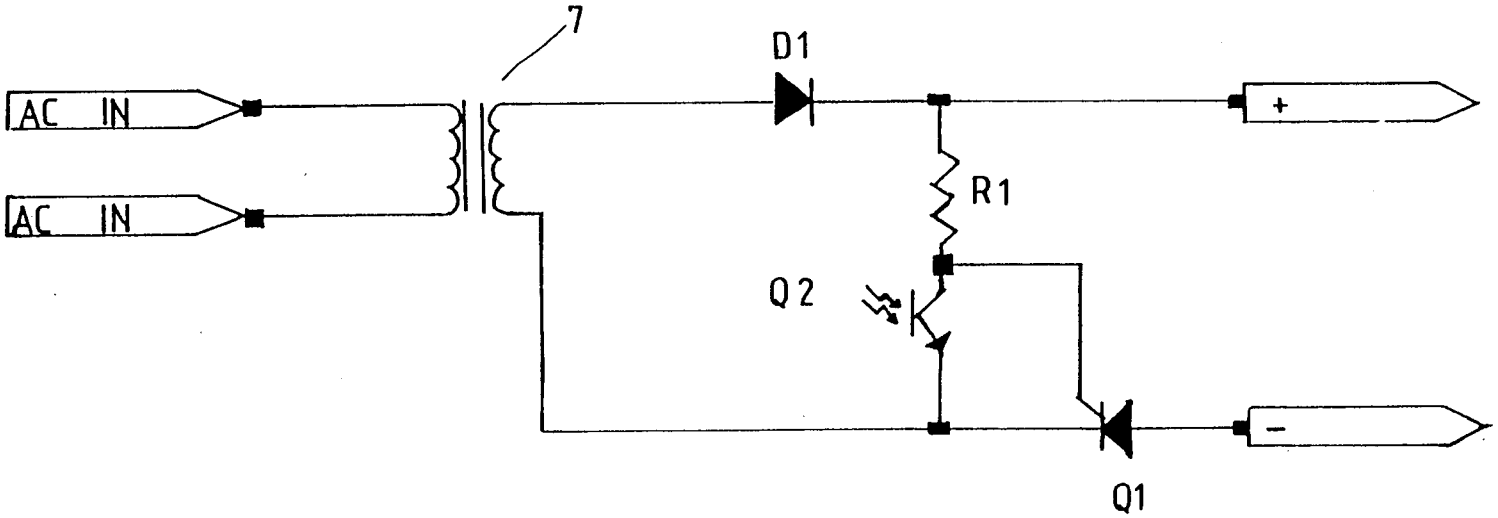
FIG. 4 illustrates a automatic dark turn on power module according to the present invention.

FIG. 4 illustrates an automatic dark turn on power module according to the present invention. Alternating current power is treated through a power supply device 7 for voltage dropping and rectified by a diode D1 to provide a direct current power. The direct current power thus obtained is sent through a silicon controlled retifier Q1 to a LED module. During the day under good vision condition, photosensor Q2 receives a large amount of light and thus cuts off the circuit to turn off the silicon controlled retifier Q1. According, no direct current power is sent to the LED module. On the contrary, the photosensor Q2 detects less amount of light under a dark condition, and the impedance of the photosensor Q2 increases. After shunt through resistor R1, the voltage from the photosensor Q2 turns on the silicon controlled retifier Q1 to provide the LED module with necessary working voltage.

Figure 5:
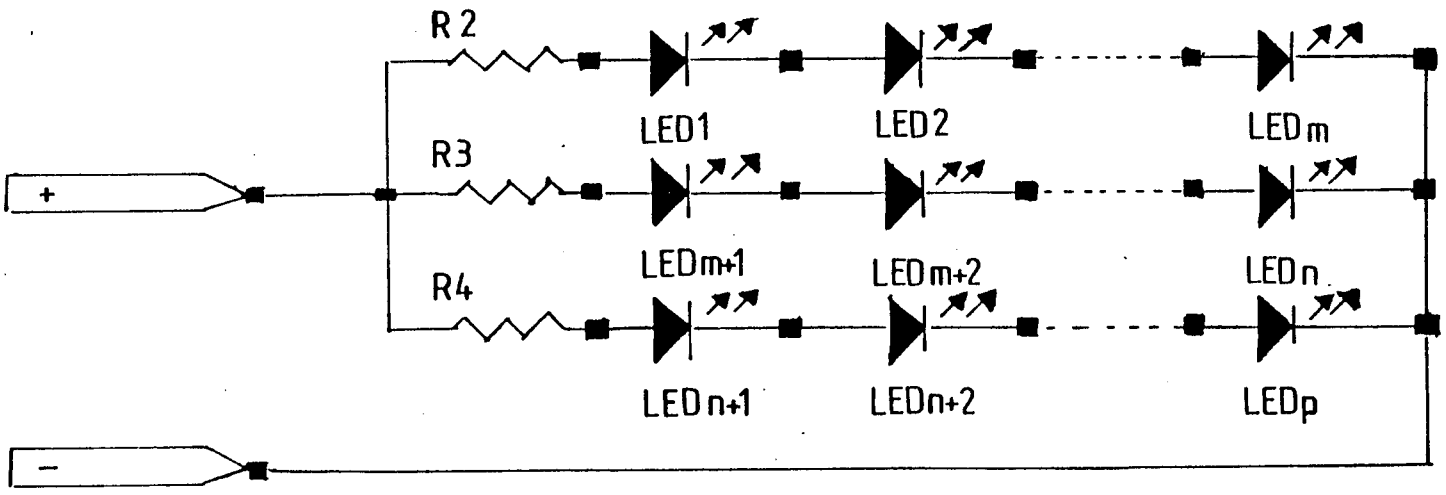
FIG. 5 illustrates a light emitting diode (hereafter LED) display module according to the present invention.

Referring to the LED display module of FIG. 5, a plurality of LEDs are connected into several branches which are disposed in parallel with each other in which each branch is comprised of a current limiting resistor (R2, R3, R4, etc.) connected with several LEDs in series. The impedance of each current limiting resistor is determined according to the total quantity of LEDs in each branch. As described, the present invention utilizes low voltage for its operation. It helps to reduce power consumption and extend LED's service life.

We claim:

1. A display board assembly comprising:

a plurality of symbol display units, each having a front panel attached to a bottom block and a printed circuit held therebetween, said bottom block having an edge about its periphery extending perpendicularly from said bottom block toward said front panel defining a top edge, a bottom edge and two side edges, two L-shaped projections extending from one of said side edges, two L-shaped recesses matching said L-shaped projections arranged within another of said two side edges; said front panel having a symbol thereon; and said printed circuit board including a plurality of LEDs corresponding to said symbol of said front panel, a power plug at one side thereof and a power socket at another side thereof adapted to receive said power plug:

said plurality of symbol display units joined together with their respective L-shaped projections received in respective L-shaped recesses of a neighboring symbol display unit and with their respective power plug received in a respective power socket of said neighboring unit; and a start unit having L-shaped recesses receiving L-shaped projections from one of said symbol display units, and an end unit having L-shaped projections received in another of said symbol display units, said start and end units together with said plurality of symbol display units forming a self-supporting structure with said start and end units each including a pair of holes and screws for fastening said display board assembly to an external surface, said end unit including a window with a photosensor therebehind for sensing the intensity of ambient light and turning on said LEDs when it is dark and an electric power supply device for converting regular alternating current power into low voltage direct current power.

2. A display board assembly as claimed in claim 1, wherein the front panel of each of said symbol display unit comprises a transparent symbol portion and an opaque non-symbol portion on its front face, said transparent symbol portion being tinted or colorless, and said opaque non-symbol portion being colored in such a way to present a striking contrast to said transparent symbol portion so that the symbol thereon can be prominent and clearly seen in the day.

3. A display board assembly as claimed in claim 1, wherein said L-shaped projections are respectively secured to said L-shaped recesses by a screw passing through said L-shaped projections and tighten into said L-shaped recesses.

4. A display board assembly as claimed in claim 1, wherein said LEDs extend from said printed circuit board toward said front panel and said printed circuit board is spaced from said front panel.

5. A display board assembly as claimed in claim 1, wherein said front panel includes an edge about its periphery extending toward said bottom block having holes at its sides for said power plug to extend therethrough.

6. A display board assembly as claimed in claim 1, wherein said plurality of LEDs are connected in several branches disposed in a parallel arrangement and each branch includes a current limiting resistor connected in series with several LEDs.

7. A display board assembly as claimed in claim 1, wherein said photosensor is arranged within a circuit for converting AC power to DC power, said photosensor arranged with a silicon controlled rectifier for inhibiting DC power to said LEDs in high light by turning said rectifier off and for supplying DC power to said LEDs in low light by turning said rectifier on.

* * * * *